United States Patent [19]

Johansen et al.

[11] Patent Number: 4,664,349

[45] Date of Patent: May 12, 1987

[54] STAND FOR WATER DISPENSER AND THE LIKE

[75] Inventors: David L. Johansen; Hung van Le, both of Los Angeles, Calif.

[73] Assignee: Arrowhead Puritas Waters, Inc., Monterey Park, Calif.

[21] Appl. No.: 825,819

[22] Filed: Feb. 4, 1986

[51] Int. Cl.[4] ..... A47G 23/02

[52] U.S. Cl. ..... 248/150; 248/152; 248/174

[58] Field of Search ..... 248/150, 152, 174; 403/205, 231; 312/257 R, 140; 222/609; 211/135, 133, 74, 85, 132

[56] References Cited

U.S. PATENT DOCUMENTS

| | | | |
|---|---|---|---|
| 712,824 | 11/1902 | Masland | 248/174 U X |
| 1,881,224 | 10/1932 | Nuckols | 248/174 |
| 1,916,471 | 7/1933 | Fallert | 248/174 |
| 1,916,647 | 7/1933 | Walker | 248/174 |
| 3,178,246 | 12/1964 | Riles . | |
| 3,323,819 | 12/1964 | Barker . | |
| 3,334,175 | 10/1964 | Vincent . | |
| 3,559,814 | 2/1971 | Downing | 211/135 |
| 3,876,270 | 4/1975 | White . | |
| 3,989,397 | 11/1976 | Baker . | |
| 4,014,618 | 3/1977 | Kristiansen . | |
| 4,044,980 | 8/1977 | Cummins | 248/459 X |
| 4,126,364 | 11/1978 | Reilly . | |
| 4,322,572 | 3/1982 | Snyder . | |
| 4,385,850 | 5/1983 | Bobath . | |
| 4,468,067 | 8/1984 | Jenkins . | |
| 4,477,201 | 10/1984 | Yoshiyuji . | |
| 4,507,815 | 4/1985 | Danko . | |
| 4,586,649 | 5/1986 | Webinger | 248/174 X |

*Primary Examiner*—J. Franklin Foss

*Attorney, Agent, or Firm*—Harris, Kern, Wallen & Tinsley

[57] ABSTRACT

A collapsible stand for a water dispenser or the like, which stand is formed of four side panels joined by corner members, with the corner members having hinged sections permitting the assembled stand to be positioned in an open configuration for use and in a flat or collapsed configuration for storage and transport.

5 Claims, 3 Drawing Figures

STAND FOR WATER DISPENSER AND THE LIKE

BACKGROUND OF THE INVENTION

This application relates to a stand or container of the type suitable for use with water dispensers, such as that currently used for supporting and dispensing of bottled water. A typical water dispenser includes a four sided stand with provision for supporting a water reservoir within the stand and supporting a bottle of water at the top of the stand. A dispensing valve and a drip tray are also included. Typical dispenser stands now in use are formed of sheet metal or of wood and have a fixed open configuration.

In the past, a variety of stands, cases, containers and the like, all of a box like shape, have been formed using corner members and side panels, with the side panels being slid or otherwise inserted into grooves in the corner members to form the open configuration unit. Typical units of this type are shown in the patents identified in the accompanying Information Disclosure Citation.

While this type of construction provides for simple assembly and disassembly of the unit, the unit once assembled is bulky and difficult to transport and store. One characteristic of all these prior designs is the utilization of a rigid corner member for strength and/or appearance. This is a serious disadvantage with the prior art designs, particularly where the units are to be assembled at one location and subsequently stored and/or transported for installation at another, and typically at a plurality of different locations.

SUMMARY OF THE INVENTION

A collapsible stand or the like having a plurality of side panels and a plurality of corner members for joining the side panels to form the stand. Each of the corner members comprises a unitary strip, typically a plastic extrusion, having first and second U-shaped sections joined by a hinge section. The U-shaped sections are adapted for receiving the edges of the side panels, typically by sliding the side panels into the U-shaped sections. The assembled side panels and corner members can be positioned in an open configuration, typically of a square or rectangular cross-section, and in a collapsed configuration with adjacent panels substantially parallel to one another. A top member having the shape of the desired open configuration cross-section may be fitted to the assembled stand when in the open configuration to define the open configuration.

The corner member itself is a feature of the invention.

The collapsible stand may be used as a stand for a water dispenser and fitted with a water reservoir, an outlet valve and a drip tray, with the top member providing for receiving and supporting a water bottle.

Accordingly, it is an object of the present invention to provide a new and improved collapsible stand which can be utilized in an open configuration, and which can be collapsed into a flat configuration for storage and transportation. A further object is to provide a unitary corner member for such a collapsible stand. An additional object is to provide such a collapsible stand which is easy, quick and simple to assemble, and which can be transported and stored in a collapsed flat condition and which is readily opened out into an open condition for installation and use as a stand.

Other objects, advantages, features and results will more fully appear in the course of the following description.

DESCRIPTION OF THE PREFERRED EMBODIMENT

Figure 1:
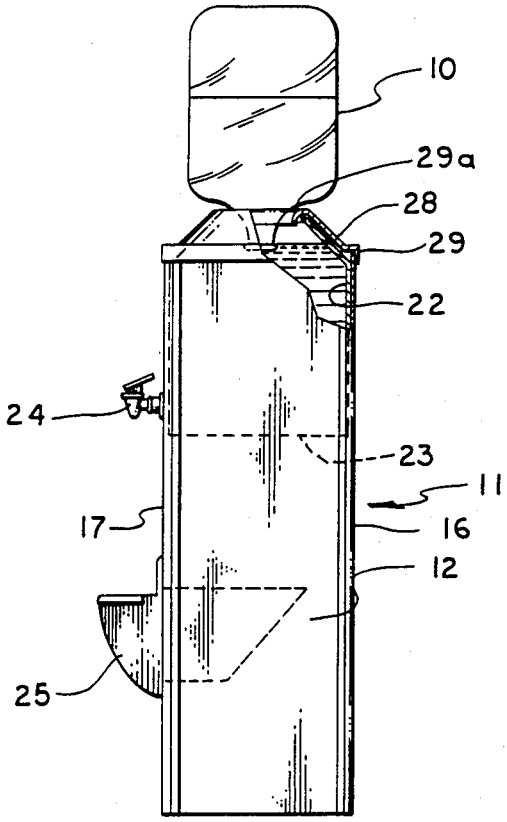
FIG. 1 is a side view of a water dispenser with a collapsible stand incorporating the presently preferred embodiment of the invention.

Referring to FIG. 1, a water bottle 10 is supported on a stand 11. In the preferred embodiment illustrated, the stand includes four side panels 12, 13, 14, 15 joined by four corner members 16, 17, 18, 19. The stand 11 when in the open configuration as shown in FIG. 1, has a square cross-section. Of course, other cross-section shapes may be utilized as desired, including rectangular, hexangonal and octagonal.

A water reservoir 22 is supported inside the stand 11 by a U-shaped bracket 23. Preferably the free ends of the arms of the bracket 23 have a 180° outward bend for resting over the upper ends of the panels 12, 14 for supporting the bracket within the stand. A dispensing valve 24 is mounted in the reservoir 23, through an opening in the panel 13. A drip tray 25 is mounted in the panel 13 below the valve 24. The water reservoir, valve and drip tray may be conventional in design.

A top member 28 has a rim 29 shaped to correspond to the cross-section of the stand, and when positioned at the end of the stand, serves to maintain the stand in the open configuration when there is nothing within the stand. There is an opening **29*a* in the top member 28 for receiving the water bottle 10**.

Figure 3:
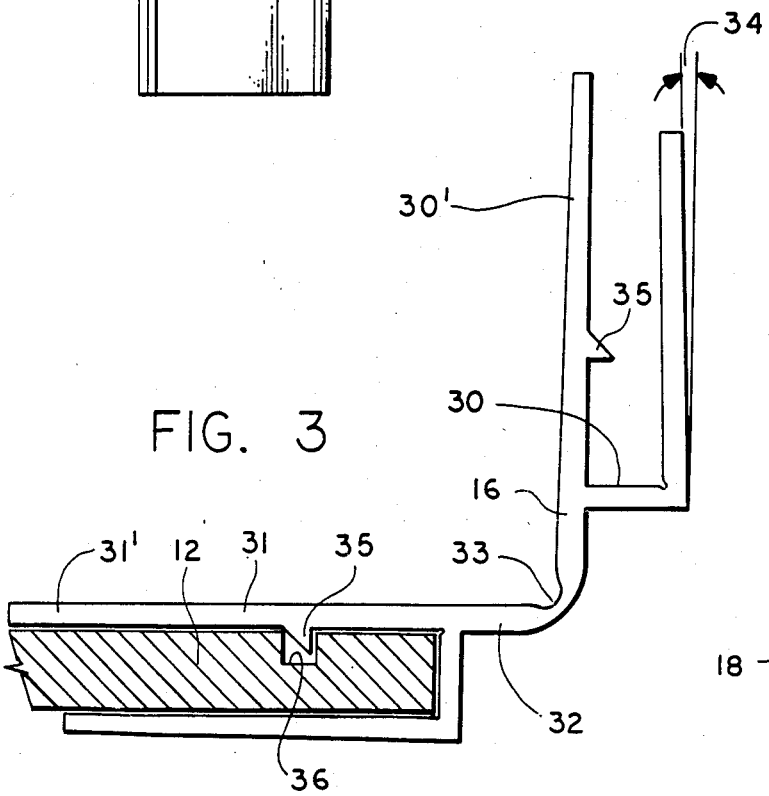
FIG. 3 is an enlarged end view of a corner member of the stand of FIG. 1, with one side panel inserted.

The corner member 16 is shown in greater detail in FIG. 3. The corner member has a U-shaped section 30 and another U-shaped section 31, with the U sections joined by a hinge section 32. The corner member has a uniform cross-section and typically is a plastic extrusion, preferably formed of a plastic material which is tough and relatively stiff in thicker sections and relatively flexible in thinner sections. Suitable materials include dual durometer polyvinyl chloride or a member of the polyolefin family.

In the embodiment illustrated, the U-shaped sections 30, 31 have thicker sections while the hinge section 32 has a thinner section at 33. With this configuration, the U-shaped sections tend to retain their shape, while the hinge section is readily bent from the 90° shape shown in FIG. 3 to the fully closed shape as shown at 16 and 18 in FIG. 2 and to the fully open shape as shown at 17 and 19 in FIG. 2. Alternatively the hinge section may be of uniform thickness.

Preferably, the distance between the arms of the U-shaped section at the bight of the U is slightly greater than the thickness of the panel. Also, rather than being parallel when at rest, the arms of the U preferably converge at a small angle indicated at 34, typically a few degrees. This design provides some gripping of the panel by the U-shaped section and serves to keep the arms of the U in contact with the panel.

In the preferred embodiment a ridge, such as the triangular ridge 35, is provided on the inner surface of at least one arm of the U-section. A corresponding groove 36 is provided in the panel. More than one ridge and groove may be used if desired. This configuration permits sliding engagement of a corner member and a panel along the longitudinal axis of the corner member as well as lateral engagement of a panel and corner member, while resisting lateral pulling of a panel from a corner member.

In use, a panel such as the panel 12 is slid into a U-shaped section such as the section 31 of the corner member 16, as shown in FIG. 3. Then the panel 15 is slid into the U-section 30. The panels 13, 14 and the corner member 18 are assembled in the same manner. Then the panels 12 and 13 are joined by the corner member 17 and the panels 14 and 15 are joined by the corner member 19. The stand assembly is now complete. Alternatively the panels may be inserted into the corner members by pushing a panel laterally into a U-shaped section. The inner arms 30', 41' of the U-sections preferably are made longer than the outer arms to aid in guiding the panels during such insertion.

Figure 2:
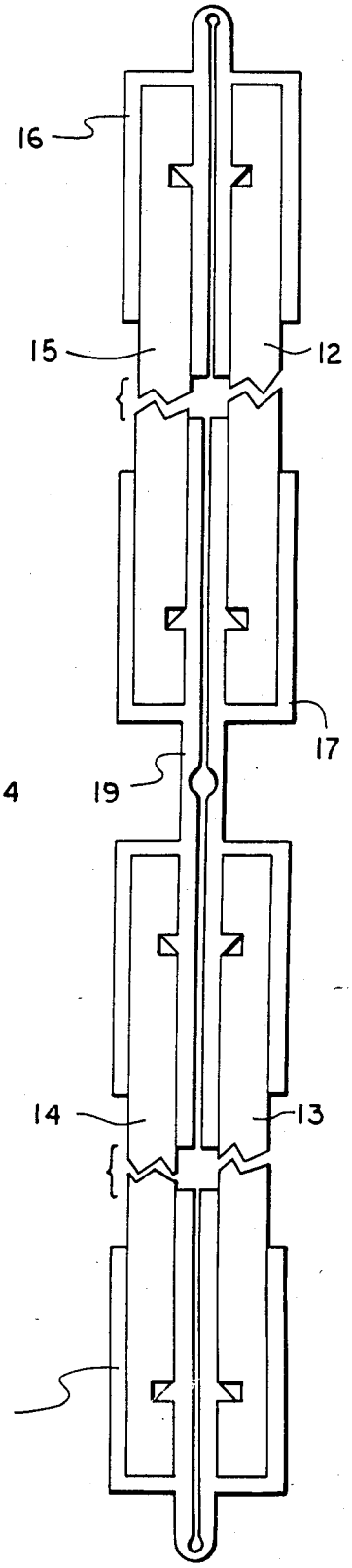
FIG. 2 is an enlarged top view of the stand of FIG. 1, in the collapsed configuration.

The stand may be collapsed to the flat configuration shown in FIG. 2 and stored or placed in a vehicle for transport. When ready for installation, the stand is opened from the flat configuration of FIG. 2 to the open configuration of FIG. 1. In some applications, the stand is now ready for use. However, if desired, some additional member may be utilized to maintain the stand is the desired open configuration. This could be an item positioned within the stand such as the reservoir 22. Alternatively it could be a member mounted at an end, such as the top member 28.

When it is desired to move or store the stand, any members attached to it or positioned within it are removed and the stand is collapsed to the configuration of FIG. 2. With this construction, this stand is easily and quickly assembled without requiring any tools or any skill, and is easily changed from the collapsed configuration to the open configuration and from the open configuration to the collapsed configuration. When collapsed, the stand is easily stored and transported.

We claim:

1. A collapsible stand for supporting a container or the like and consisting essentially of:

a plurality of flat uncreased side panels, each of said side panels having opposed edges; and a corresponding plurality of corner members, each of said corner members comprising a unitary strip having first and second U-shaped sections for receiving edges of said side panels, with said U-shaped sections joined by a hinge section;

with said side panel edges inserted into corresponding corner member U-shaped sections to form an assembled self-supported stand, which stand can be positioned in an open configuration with adjacent panels joined at an angle to one another and in a collapsed configuration with adjacent panels substantially parallel to one another with said panels and said corner member U-shaped section having inter-engaging means for sliding engagement and sliding disengagement of said panel and said corner members, and which stand can be assembled and disassembled a plurality of times by insertion and removal of panels into and from corner member U-shaped sections.

2. A collapsible stand as defined in claim 1 including a top member fitted at one end of the said assembled stand defining said open configuration.

3. A collapsible stand as defined in claim 1, wherein each of said corner members is of uniform cross-section along its length, and said hinge section includes a zone of lesser thickness.

4. A collapsible stand as defined in claim 1, wherein each of said U-shaped sections includes an inwardly projecting ridge on one of the arms of the U, and each of said panels includes a groove at each edge for engagement with one of said ridges.

5. A corner member for a collapsible stand having a plurality of side panels, said corner member comprising a unitary strip having first and second U-shaped sections for receiving edges of side panels, with said U-shaped sections joined by a hinge section so that a plurality of side panels may be inserted into a plurality of corner member U-shaped sections to form an assembled stand, which stand can be positioned in an open configuration with adjacent panels at an angle to one another and in a collapsed configuration with adjacent panels substantially parallel to one another, with the arms of said U-shaped sections converging toward the open end of the U, and with each of said U-shaped sections including an inwardly projecting ridge on one of the arms of the U for engagement with a groove at an edge of a side panel.

* * * * *